US008690048B2

(12) United States Patent
Philips et al.

(10) Patent No.: US 8,690,048 B2
(45) Date of Patent: Apr. 8, 2014

(54) REINFORCED CONTAINER SYSTEM

(76) Inventors: Nicholas A. Philips, Sugar Grove, IL (US); Wayne H. Kuhn, Palos Park, IL (US)

( * ) Notice: Subject to any disclaimer, the term of this patent is extended or adjusted under 35 U.S.C. 154(b) by 262 days.

(21) Appl. No.: 13/290,333

(22) Filed: Nov. 7, 2011

(65) Prior Publication Data

US 2013/0112739 A1 May 9, 2013

(51) Int. Cl.
*B65D 5/62* (2006.01)

(52) U.S. Cl.
USPC ... 229/199; 229/109; 229/117.28; 229/117.3; 229/117.35; 366/209; 366/605; 220/495.05; 220/495.06; 220/23.91; 220/648

(58) Field of Classification Search
USPC ..... 229/109, 117.27, 117.28, 117.3, 229/117.35, 199; 220/495.02, 495.03, 220/495.01, 495.05, 495.06, 23.91, 646, 220/648, 730; 366/209, 605; 206/521
See application file for complete search history.

(56) References Cited

U.S. PATENT DOCUMENTS

| | | | | | |
|---|---|---|---|---|---|
| 963,719 | A | | 7/1910 | Mellen | |
| 1,550,646 | A | * | 8/1925 | Larson | 206/521 |
| 1,735,082 | A | * | 11/1929 | Martin | 62/60 |
| 1,865,688 | A | * | 7/1932 | Hannaford | 62/371 |
| 3,937,392 | A | * | 2/1976 | Swisher | 229/108 |
| 4,320,866 | A | | 3/1982 | Gardner | |
| 4,341,337 | A | * | 7/1982 | Beach et al. | 229/108.1 |
| 4,411,373 | A | * | 10/1983 | Kupersmit | 229/199 |
| RE33,128 | E | * | 12/1989 | Nordstrom | 229/117.27 |
| 5,282,544 | A | | 2/1994 | Boots | |
| 5,711,632 | A | | 1/1998 | Garrahan | |
| 6,932,266 | B2 | * | 8/2005 | Jones et al. | 229/199 |
| 6,945,690 | B2 | * | 9/2005 | Armendariz et al. | 366/209 |
| 6,986,436 | B2 | | 1/2006 | Smith | |
| 7,651,024 | B2 | | 1/2010 | Barner | |
| 7,806,313 | B2 | | 10/2010 | Philips | |
| 7,870,992 | B2 | * | 1/2011 | Schille et al. | 229/103.11 |
| 2003/0160092 | A1 | * | 8/2003 | Philips et al. | 229/122.32 |
| 2005/0189404 | A1 | * | 9/2005 | Xiaohai et al. | 229/103.11 |
| 2005/0258187 | A1 | | 11/2005 | Savage | |
| 2010/0102113 | A1 | * | 4/2010 | LeBras | 229/200 |

FOREIGN PATENT DOCUMENTS

| | | |
|---|---|---|
| DE | 4238953 | 5/1994 |

* cited by examiner

*Primary Examiner* — Gary Elkins
*Assistant Examiner* — Scott McNurlen
(74) *Attorney, Agent, or Firm* — Matthew M. Eslami

(57) ABSTRACT

A reinforced container system comprises a container having a bottom wall, a pair of opposite side walls, a pair of opposite end walls, and opposed pairs of diagonal corner panels interposed between adjacent side and end walls to form an interior space. The bottom wall includes two opposed glue panels each of which is foldably joined to respective longitudinal edges of the bottom wall and each of which attached to the respective side walls. A protective sleeve is configured to detachably attach to the container. The protective sleeve includes two side walls, two end walls and opposed pairs of diagonal corner walls interposed between adjacent side and end walls. The side walls, the end walls and the diagonal corner walls are joined to one another along four vertical hinges to whereby protect the container against tremendous forces and inertia caused by mixing or shaking machinery.

12 Claims, 8 Drawing Sheets

REINFORCED CONTAINER SYSTEM

FIELD OF THE INVENTION

The present invention relates generally to packaging for shipping and storing flowable products. A thin plastic inner bag for the liquid is placed within a reinforced corrugated container system for structural rigidity and protection. The reinforced container system is particularly suitable for products such as paints that must be severely agitated in the container to disperse and homogenize the contents before use.

BACKGROUND OF THE INVENTION

Corrugated paperboard containers are used to store and transport a variety of goods. It has been common practice for many years to ship liquid materials contained within plastic bags enclosed. Corrugated paperboard containers are used to contain a flexible plastic inner container, also known as bag-in-box, with a pull-up spout for filling and dispensing the liquid contents. Any package placed inside commercial paint mixing/shaking machinery is subjected to tremendous forces and inertia for an extended period of time. A bag-in-box, although having significant economic and environmental impact advantages over a traditional round rigid plastic pail, is obviously more vulnerable to the abuses such machinery generates. Accordingly, various methods have been employed for reinforcing the side walls of the box or container. Such methods have included the use of plastic girdling straps, strings, wrapping the raised and/or filled container with plastic wrap, or providing tape, referred to as "sesame" tape, that is laminated into the corrugated material. Each of these methods, while effective in providing reinforcement, may be undesirable for one or more reasons, such as increased material and/or manufacturing costs (such as the sesame tape), or increased overall operational costs and/or setup time/steps. In addition, in many of these designs, particularly those that involve the placement of external reinforcement (plastic strapping, wound plastic wrap or strings), because the reinforcement is provided after the container has been raised, the reinforcement members' force is directed typically mostly on the corners of the container, and not on the bulging sidewall surfaces.

Therefore, it would be desirable to provide a reinforced container system construction for a collapsible container of the type fabricated entirely from corrugated paperboard materials, which is simple in form, and which does not significantly increase material and manufacturing costs.

SUMMARY OF THE INVENTION

The reinforced container system of the present invention can reliably survive the tremendous forces and inertia for an extended period of time caused by mixing/shaking machinery without additional protection and to maximize the economy of the package and add an additional safeguard in the case of a package which may have been in some way pre-abused prior to insertion into the mixing machine.

The reinforced container system of the present invention includes a lightweight, collapsible, re-usable protective sleeve that can be used at, for instance, a paint retail store, to house a bag-in-box package that contains, for instance, 1-5 gallons of paint. This sleeve is utilized during the use of commonly available mechanical mixing machinery and is removed from the main paint package by a retail worker prior to product's store departure. It is previously determined that an octagonally-shaped container optimizes all desired physical and economic attributes for such a retail package. Thus, protective sleeve for this container is accordingly shaped to accommodate that exact shape. Some very important features of the protective sleeve are: 1) lightweight fracture-resistant materials used such as plastic resins, aluminum or graphite fiber, 2) further light-weighting due to weight-reduction holes in the side-walls so that it reduces electrical load on mixing machineries, 3) a geometry which allows placement of the sleeve over the top of a heavy package and details (i.e.; finger holes) which then allow it to be removed from the top, without requiring lifting of the main package/box, 4) hinged and/or foldable collapsibility features which allow the sleeve to be stored without consuming too much valuable retail storage space or counter space, when it is not used, 5) maximum surface contact between all container outer vertical panels and all corresponding sleeve inner vertical walls (form-fitting), 6) Sleeve height being slightly less than container height, so that mixing machinery holding platens can apply adequate pressure to the container, such that the entire bag-in-box is secured in the machinery throughout the entire liquid mixing process.

During mixing machine operation, the bag-in-box walls flex and pulsate constantly, because the inner liquid displaces in all directions. This protective sleeve allows the lightest possible paper material be used in the container's construction because the need for flex and tear resistance is greatly reduced by sleeve containment. Such a sleeve can be effectively used in the many different types of mixing machinery in use such as, but not limited to, oscillating, orbital and gyroscopic.

Accordingly, one aspect of the present invention is directed to a reinforced container system comprises a container having a bottom wall, a pair of opposite side walls, a pair of opposite end walls, and opposed pairs of diagonal corner panels interposed between adjacent side and end walls to form an interior space. The bottom wall, the side walls, the end walls and the diagonal corner panels are joined to one another along vertical folds. The bottom wall includes two opposed glue panels each of which is foldably joined to respective longitudinal edges of the bottom wall and each of which attached to the respective side walls. A protective sleeve is configured to detachably attach to the container. The protective sleeve includes two side walls, two end walls and opposed pairs of diagonal corner walls interposed between adjacent side and end walls. The side walls, the end walls and the diagonal corner walls are joined to one another along four vertical hinges to whereby protect the container against tremendous forces and inertia caused by mixing or shaking machinery.

Another aspect of the present invention is directed to a reinforced container system comprises a container having a bottom wall, a pair of opposite side walls, a pair of opposite end walls, and opposed pairs of diagonal corner panels interposed between adjacent side and end walls. The bottom wall, the side walls, the end walls and the diagonal corner panels are joined to one another along vertical folds to form an interior space. The bottom wall includes two opposed glue panels each of which foldably joined to respective longitudinal edges of the bottom wall and each of which attached to the respective side walls. A liner insert is disposed in the container and is fitting closely in the container sidewalls and bottom wall in an overlapping relationship. A plastic bag is disposed in the interior space of the container and is confined within the liner insert in which the plastic bag includes a spout for flowable material. A protective sleeve is configured to detachably attach to the outer wall of the container. The protective sleeve includes two opposed side walls having inner surfaces, two opposed end walls and opposed pairs of diagonal corner walls interposed between adjacent side and end walls. The side walls, the end walls and the diagonal corner walls are joined to one another along four vertical hinges to whereby protect the container against tremendous forces and inertia caused by mixing or shaking machinery.

One further aspect of the present invention is directed to a reinforced container system comprises a container having a bottom wall, a pair of opposite side walls, a pair of opposite end walls, and opposed pairs of diagonal corner panels interposed between adjacent side and end walls. The bottom wall, the side walls, the end walls and the diagonal corner panels are joined to one another along vertical folds to form an interior space. The bottom wall includes two opposed glue panels each of which is foldably joined to respective longitudinal edges of the bottom wall and each of which attached to the respective side walls. A liner insert is disposed in the container and is fitting closely in the container sidewalls and bottom wall in an overlapping relationship. The liner insert is substantially coextensive in height with the container side walls and diagonal corner panels. A plastic bag is disposed in the interior space of the container and is confined within the liner insert. The plastic bag includes a spout for flowable material. A protective sleeve is configured to detachably attach to the outer wall of the container. The protective sleeve includes two opposed side walls having inner surfaces, two opposed end walls and opposed pairs of diagonal corner walls interposed between adjacent side and end walls. Two retaining plates each of which is attached to the respective inner surface of the side walls and aligned with the respective top edge of each side wall of the sleeve and extend downwardly therefrom. The side walls, the end walls and the diagonal corner walls are joined to one another along four vertical hinges to whereby protect the container against tremendous forces and inertia caused by mixing or shaking machinery.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
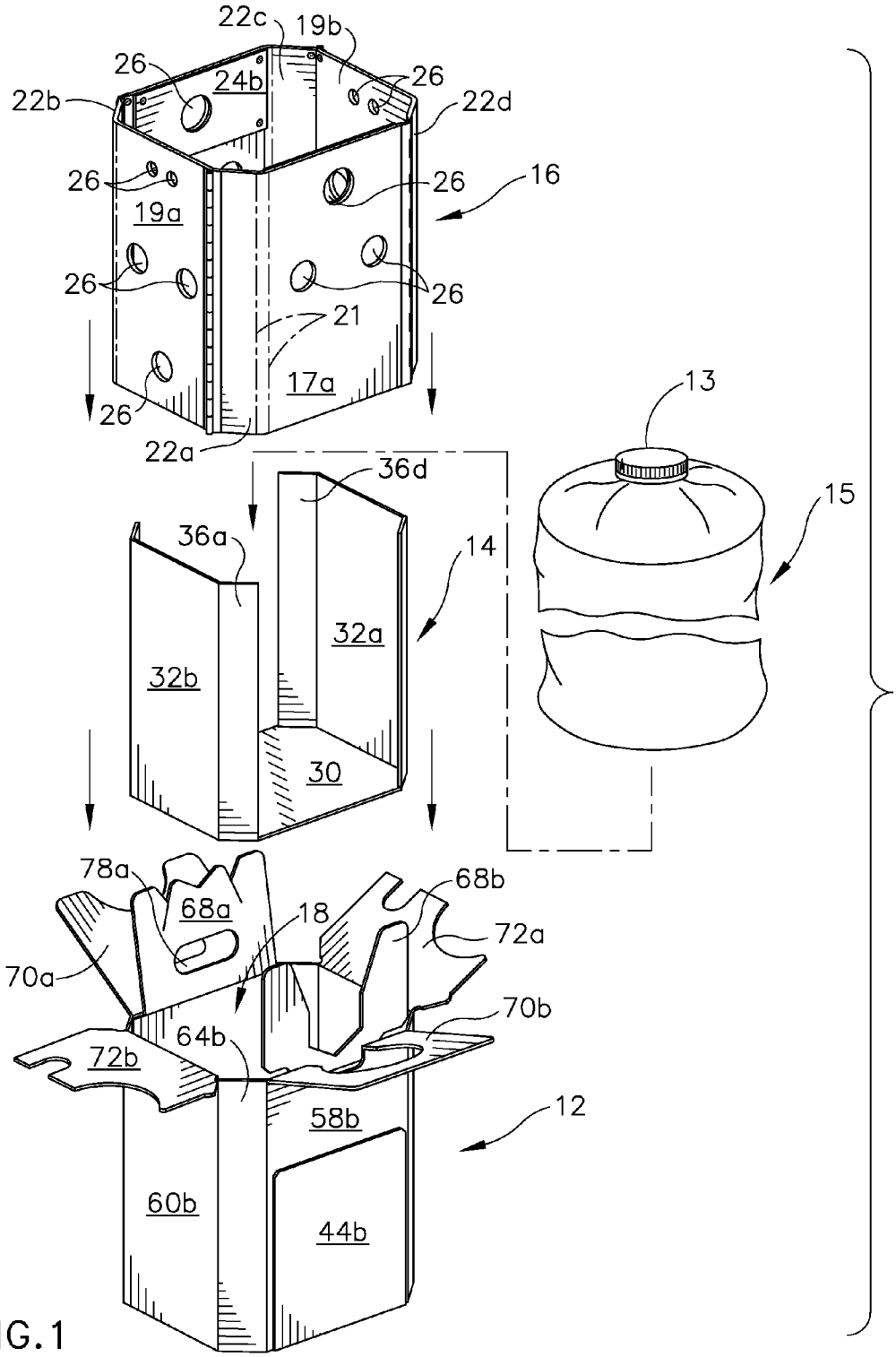
FIG. 1 is an exploded perspective view of a container, a liner insert, a bag, and a protective sleeve in a spaced relationship with one another in accordance to the preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

Figure 2:
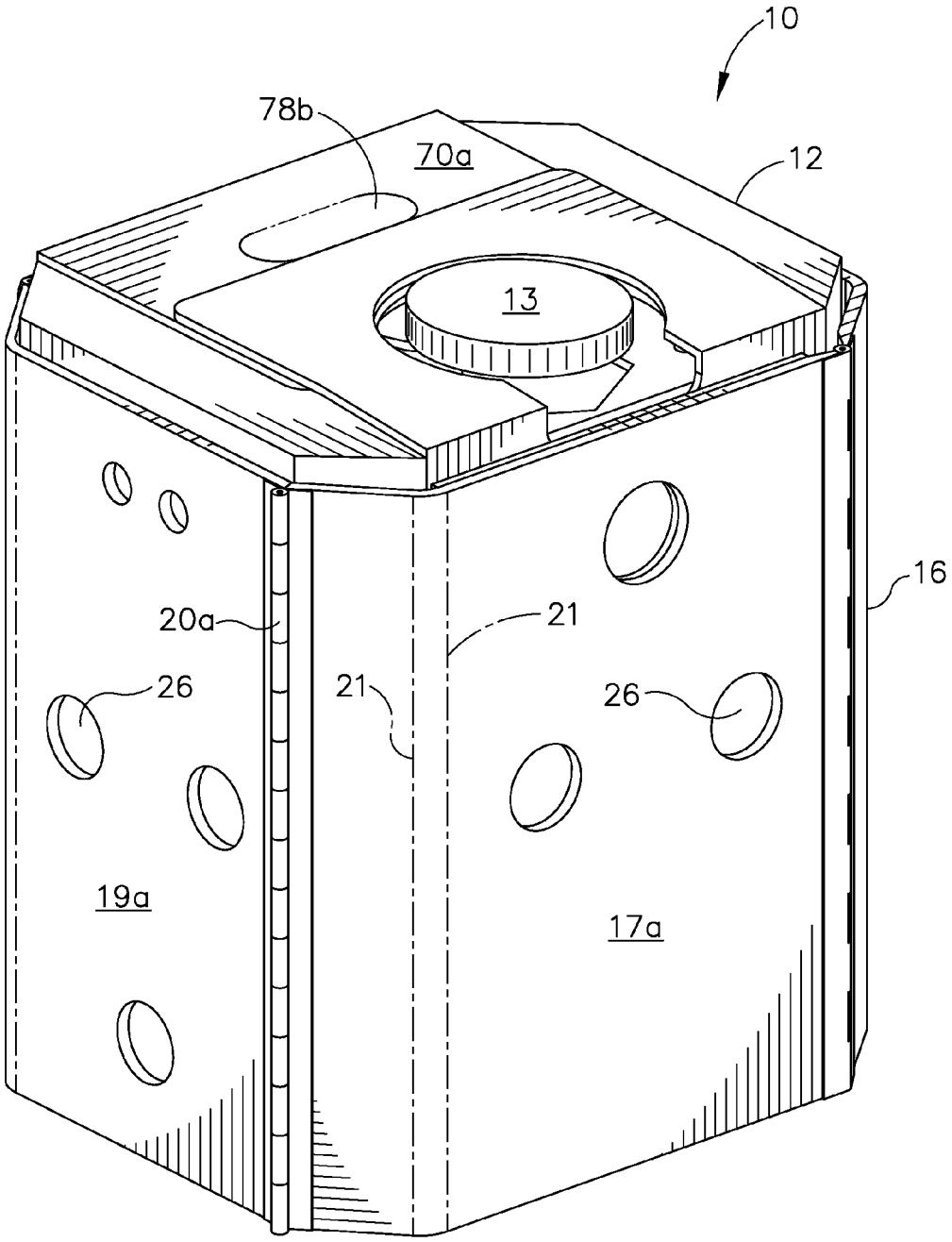
FIG. 2 is a top perspective view of an assembled reinforced container system constructed from FIG. 1.

FIG. 1 is an exploded perspective view of a reinforced container system 10 which is shown in an assembled form in FIG. 2 in accordance to the preferred embodiment of the invention. The reinforced container system 10 comprises a container 12, a liner insert 14, a bag 15, and a protective sleeve 16. The liner insert 14 is snugly fit into an interior space 18 and the protective sleeve 16 is detachably attached to the exterior of the container 12. The protective sleeve is snugly placed around the outer side walls of the container 12 as depicted in FIG. 2. The reinforced container system 10 includes a bag or plastic jug or bladder 15 for storing and transporting liquid therein. The bag or plastic jug or bladder 15 would normally be blow molded from polyethylene or a similar material. Preferably, it should have sufficient flexibility so that it can be at least partially collapsed prior to filling or following withdrawal of some of the contents. This flexibility is desirable to minimize the amount of space required to inventory the containers prior to filling and for ultimate disposal. The bag or plastic jug or bladder 15 will normally have an integral spout 13 attached to the upper portion of the bag for transferring liquid into and/or out of the bag. The container 12 is preferably made of corrugated paperboard and protective sleeve 16 is made of plastic.

Figure 3:
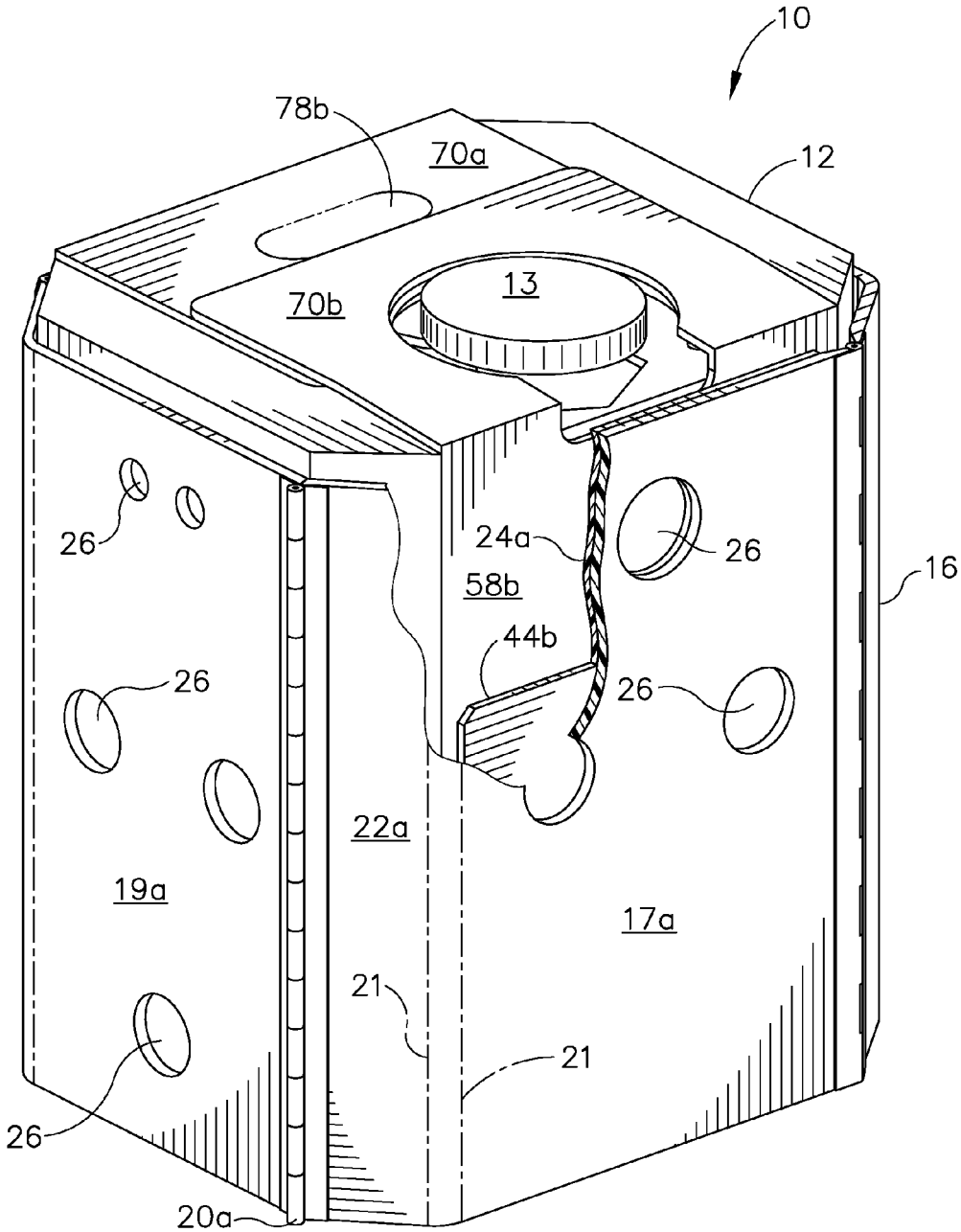
FIG. 3 is a top perspective view of the reinforced container system in FIG. 2 with a portion of the protective sleeve being removed to illustrate contact surfaces of the container and the sleeve.
Figure 4:
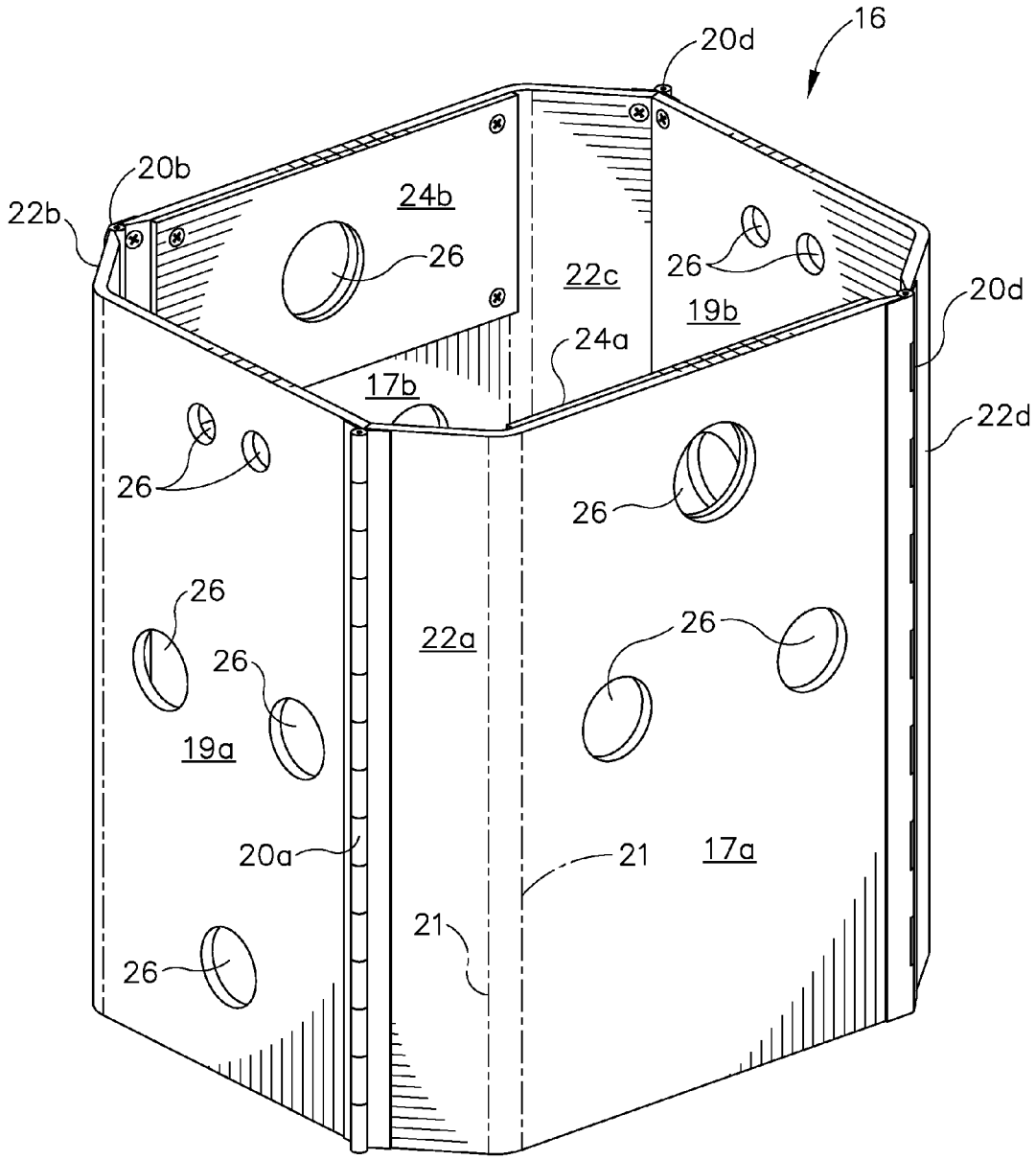
FIG. 4 is a top perspective view of the sleeve alone in accordance to a preferred embodiment of the present invention.
Figure 5:
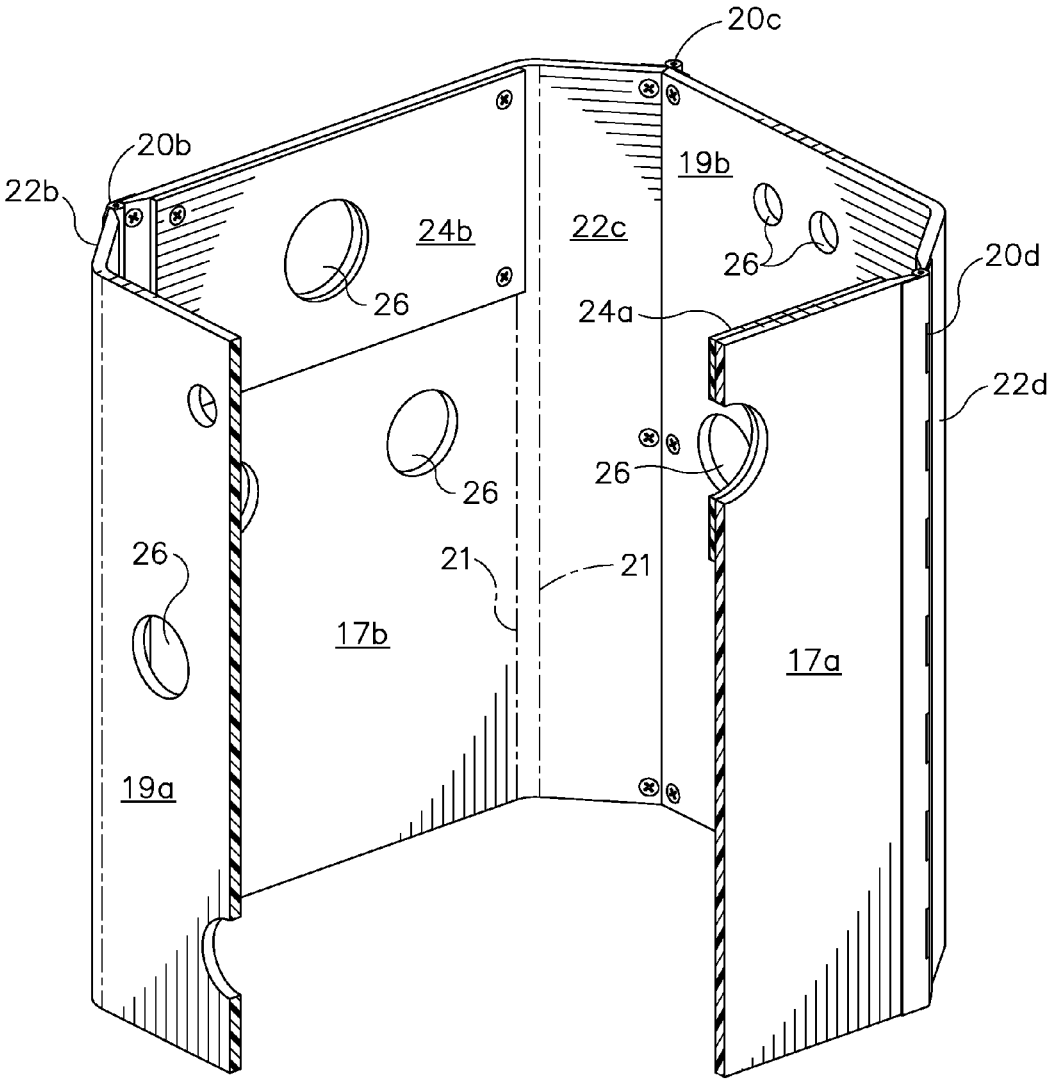
FIG. 5 is a fragmentary perspective view of a portion of the protective sleeve of FIG. 4, showing interior of the protective sleeve.
Figure 6:
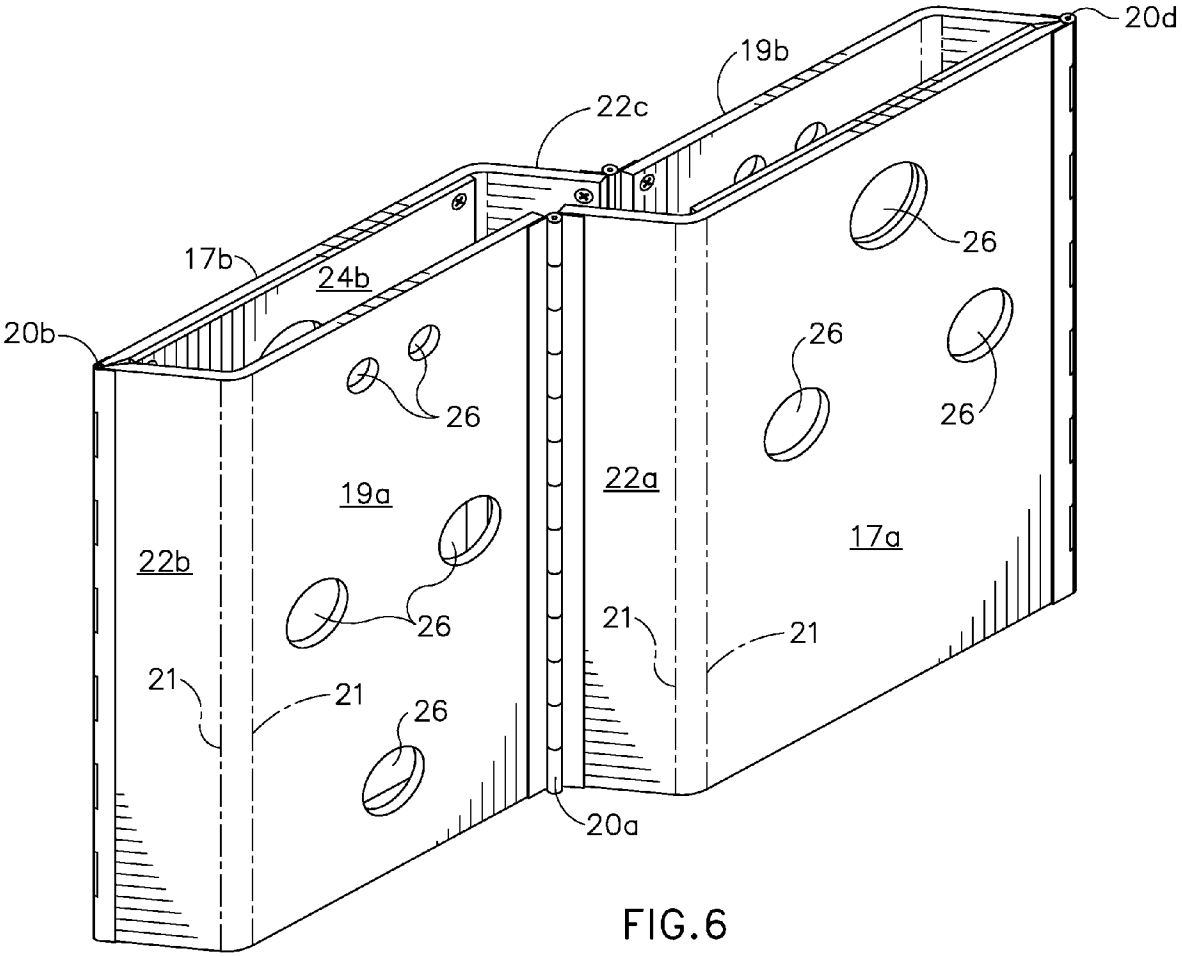
FIG. 6 is a top perspective view of the sleeve in FIG. 4 in a collapsed position.

Referring to FIG. 4, the protective sleeve 16 comprises two side walls 17*a*, 17*b*, two end walls 18*a*, 18*b* and opposed pairs of diagonal walls 22*a*, 22*b*, 22*c*, 22*d* interposed between adjacent side and end walls to form an octagonally-shaped open-ended tubular. The protective sleeve 16 is provided with four hinges or foldable collapsibility features 20*a*, 20*b*, 20*c*, and 20*d* used to attach the side walls 17*a*, 17*b* and end walls 19*a*, 19*b* to one another and permit the sleeve 16 to be folded or collapsed onto itself as depicted in FIG. 6. The hinges or foldable collapsibility features 20*a*, 20*b*, 20*c*, and 20*d* permit the protective sleeve 16 to be stored without occupying too much valuable retail storage space when the sleeve is not being used. Each of the hinges 20*a*, 20*b*, 20*c*, and 20*d* extends in a direction substantially parallel to a vertically extending direction along the side walls 17*a*, 17*b* and end walls 18*a*, 18*b*. Each of the diagonal panels 22*a*, 22*b*, 22*c*, 22*d* extends integrally from respective side walls 17*a*, 17*b* and end walls 19*a*, 19*b* via tension lines or phantom lines 21 as shown in FIGS. 4 and 6. For example, the diagonal panel 22*a* extends from the side wall 17*a*, the diagonal panel 22*b* extends from the end wall 19*a*, the diagonal panel 22*c* extends from the side wall 17*b*, and the diagonal panel 22*d* extends from the end wall 19*b*. Two retaining plates 24*a*, 24*b*, each of which is attached to the respective inner surface of side wall 17*a* and 17*b* as shown in FIGS. 4 and 5. The top edge of the each retaining plate 24*a*, 24*b* is aligned with the respective top edge of each side wall 17*a*, 17*b* and extends downwardly therefrom as depicted in FIG. 3. The respective retaining plates 24*a*, 24*b* are fastened adhesively or otherwise bolted, but not limited to, to the respective inner surface of the side walls 17*a* and 17*b*. The retaining plates 24*a*, 24*b* are identical in shape and have a predetermined height which allows the protective sleeve 16 to be removed from the top of the container 12 without lifting the heavy container 12 and will be described in greater detail herein below. The protective sleeve 16 contains several perforations 26 of different sizes which reduce the overall weight of the protective sleeve 16 and further permits to reduce the electrical load on mixing machineries. In addition, the perforations 26 permit the passage of heat or moisture which might have generated during the shaking operation of the reinforced container system 10. The height of the protective sleeve 16 is slightly less than the height of the container 12 so that the mixing machinery holding platens can apply adequate pressure to the container 12 such that the entire bag-in-box is secured in the machinery throughout the entire liquid mixing process. The protective sleeve is preferably made of a lightweight fracture-resistant materials such as plastic resins, aluminum or graphite fiber.

Figure 7:
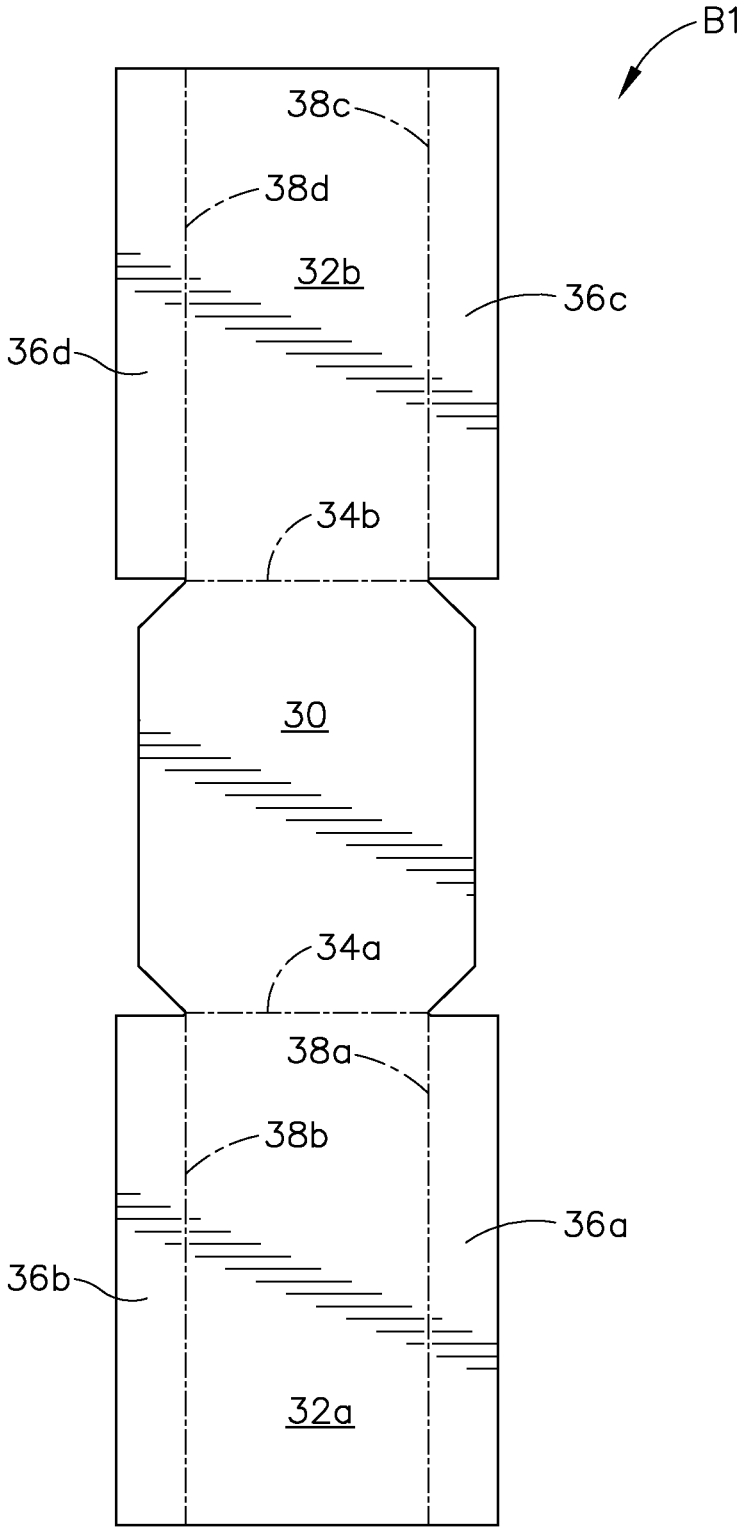
FIG. 7 is a top plan view of a blank B1 for making the liner insert shown in FIG. 1.

Referring to FIG. 7, which is a top plan view of a blank B1 for making the liner insert 14 shown in FIG. 1. The blank B1 is substantially flat symmetrical with respect to its lateral axis thereof. The blank B1 is preferably an integral piece of a material such as continuous sheet of conventional corrugated cardboard. The blank B1 is cut along its outer margins to form its specific shape so that corresponds to the shape of the container side walls and bottom wall. The blank B1 is divided into an insert central panel 30 and two identical insert side panels 32*a*, 32*b* foldably extend outwardly from opposed lateral edge of the central panel 30 via fold lines 34*a* and 34*b*. The liner insert 14 is positioned inside the container 12 so that the insert central panel 30 sits on the bottom of the container 12 in an overlapping relationship and is octagonally-shaped so that it corresponds to the bottom shape of the container 12. Each of the insert side panels 32*a*, 32*b* includes a pair of insert side flaps 36*a*, 36*b*; 36*c*, 36*d* extends foldably from the respective opposed longitudinal edges of the insert side panels 32*a*, 32*b* via fold lines 38*a*, 38*b*, 38*c*, and 38*d*. The insert side panels 32*a*, 32*b* including the insert side flaps 36*a*, 36*b*, 36*c*, 36*d* positioned inside the container 12 in contact with the end walls including the diagonal walls in an overlapping relationship. The liner insert 14 has truncated corners that serve as top-to-bottom corner post and used to double the end walls thickness of the container 12.

Figure 8:
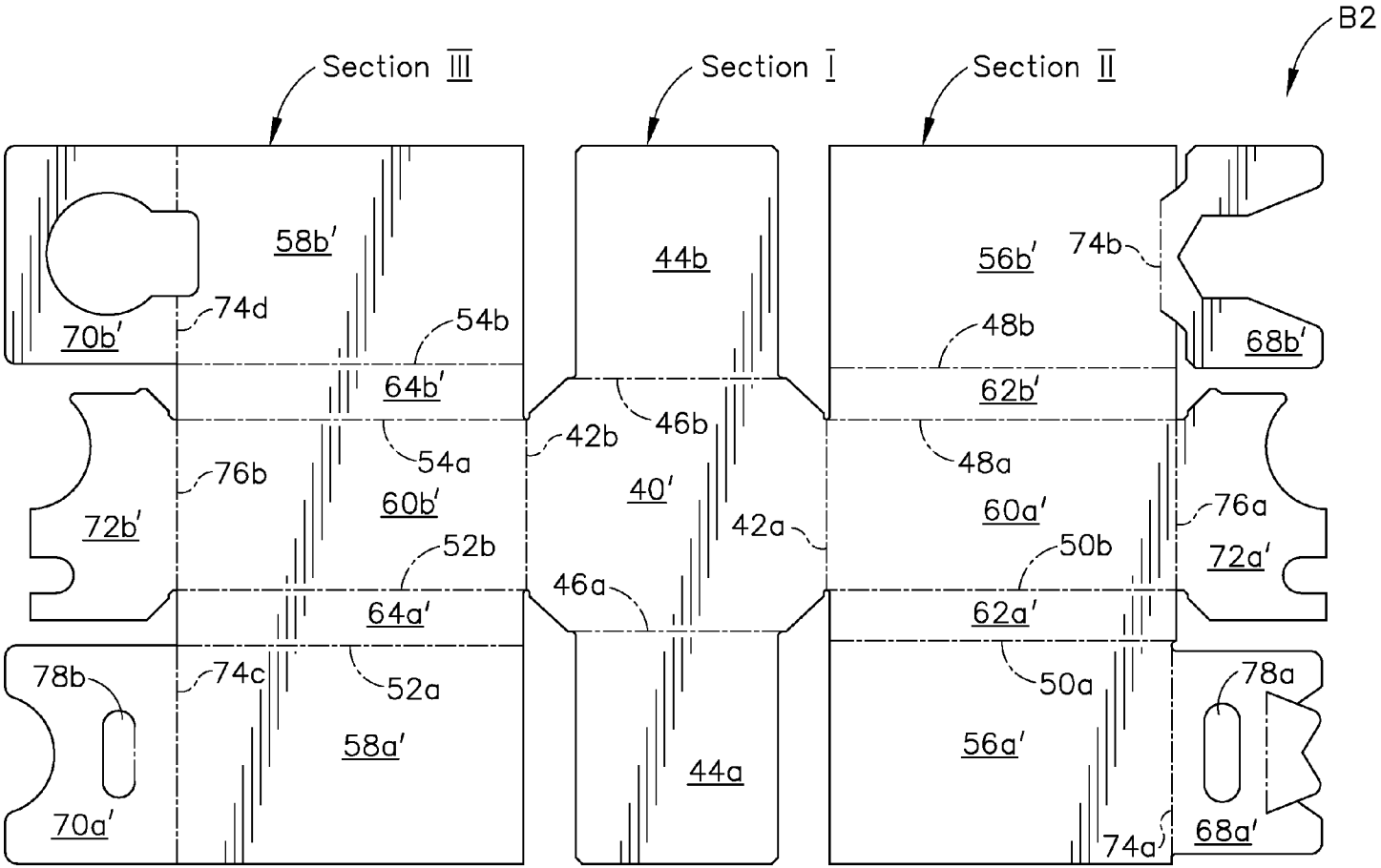
FIG. 8 is a top plan view of a blank B2 for making the container in FIG. 1 in accordance to a preferred embodiment of the present invention.

Turning now to FIG. 8, which is a top plan view of a blank B2 for making the container 12 in FIG. 1 in accordance to a preferred embodiment of the present invention. The blank B2 is substantially flat symmetrical with respect to its lateral axis thereof. The blank B2 is preferably an integral piece of a material such as continuous sheet of conventional corrugated cardboard. The blank B2 is cut along its outer margins to form its specific shape so that corresponds to the shape of the container 12. The blank B2 is divided into three sections I, II, III by two lateral fold lines 42*a*, 42*b*. Section I includes a bottom wall panel 40' including a pair of glue panels 44*a*', 44*b*' each of which foldably joined to respective longitudinal edges of the bottom wall panel via fold lines 46*a*, 46*b*. The bottom wall panel 40' is truncated at its corners to form an octagonal shape. Sections II and III, each of which are foldably joined to respective opposed lateral edges of bottom wall panel 40' via respective fold lines 42*a* and 42*b*. In the exemplary blank B2, it should be noted that the section II, III are substantially similar to one another. Each of the sections II, III is further divided into respective side walls 56*a*', 56*b*', 58*a*', 58*b*' and end walls 60*a*', 60*b*' by respective fold lines 48*a*, 48*b*; 50*a*, 50*b*; 52*a*, 52*a*; and 54*a*, 54*b*. For example, in section II, the side walls 56*a*', 56*b*' and the end wall 60*a*' are foldably joined with one another and in section III, the side walls 58*a*', 58*b*' and the end wall 60*b*' are foldably joined with one another as well.

Each of the sections II, III includes a pair diagonal wall panels 62*a*', 62*b*'; 64*a*', 64*b*' defined by respective fold lines 50*a*, 50*b*; 48*a*, 48*b*; 52*a*, 52*b*; 54*a*, 54*b*. The diagonal wall panels 62*a*', 62*b*' extend from the longitudinal edges of side walls 56*a*', 56*b*' and end wall 60*a*' and the diagonal wall panels 64*a*', 64*b*' extend from the longitudinal edges of side walls 58*a*', 58*b*' and end wall 60*b*'. Each of the side walls 56*a*', 56*b*', 58*a*', 58*b*' and end walls 60*a*', 60*b*'includes a respective first top flap 68*a*', second top flap 68*b*', third top flap 70*a*', fourth top flap 70*b*' and fifth top flap 72*a*', sixth top flap 72*b*' each of which foldably joined to the respective side walls and end walls via respective fold lines 74*a*, 74*b*, 74*c*, 74*d*, and 76*a*, 76*b*. These flaps will form the top wall of the container 12 when the blank B2 is fully constructed. It should be noted that each of the first top flap 68*a*', second top flap 68*b*', third top flap 70*a*', fourth top flap 70*b*' and fifth top flap 72*a*', sixth top flap 72*b*' is cut along its outer margins to form its specific shape so that it is capable to hold and protect the spout 13 when these flaps are in folded positions. In addition, each of the first top flap 68*a*' and the fourth top flap 70*b*' includes cut outs 78*a*, 78*b* that aligned with one another to form a hand hole opening 78 when the blank B2 is fully constructed.

In use, the manual set-up of the blank B2 is easily accomplished. However, a person ordinary skilled in the art would appreciate that generally a folding machine may alternatively perform the forming operations. After die cutting the blank B2 at the converting plant, the blank B2 is laid horizontally and Section II and III are folded upwardly at right angle along fold lines 42*a*, 42*b*, which brings respective side walls 56*a*', 56*b*', 58*a*', 58*b*' and end walls 60*a*', 60*b*' in a respective plane that is substantially perpendicular to the bottom panel 40'. The folding sequence continues by folding the side panels 56*a*', 56*b*' including the diagonal wall panels 62*a*', 62*b*' around respective fold lines 50*a*, 48*b*, such that these panels align with the perimeter defined by fold lines 46*a* and 46*b* and the truncated corner of the bottom wall 40'. Similarly, the by folding the side panels 58*a*', 58*b*' including the diagonal wall panels 64*a*', 64*b*' around respective fold lines 52*b*, 54*a*, such that these panels align with the perimeter defined by fold lines 46*a* and 46*b* and the truncated corner of the bottom wall 40'. In this configuration, the side panels 58*a*', 58*b*' and the side panels 56*a*', 56*b*' are in overlapping relationship, giving this region of the container a double wall thickness which they can be glued to one another, if desired. Next, the glue panels 44*a*', 44*b*' are folded upwardly at right angle along the fold lines 46*a*, 46*b* and are glued to the respective side walls 56 and 58. Next, the insert liner 14 is placed inside the container 12 in a manner that entirely overlapped with the end walls 60*a*', 60*b*' including the diagonal wall panels 62, 64, giving this region a double wall thickness as well. After a bag or plastic jug or bladder having a dispensing valve is placed in the interior space 18 of the container, the first top flap 68*a*' and the second top flap 68*b*' are folded toward the center of the container while the dispensing valve is protruded from the second top flap 68*b*' and glued to one another. Next, the fifth top flap 72*a*' and sixth top flap 72*b*' are folded toward the center of the container and glued to one another and finally the fifth top flap 72*a*', sixth top flap 72*b*' are folded toward the center of the container and glued to one another as depicted in FIG. 2.

The reinforced container 10 assembly of the present invention avoids the drawbacks of prior art containers, including general structural weakness, loose fitting top cover and bulkiness of shipping. The inventive reinforced container 10 assembly has a small footprint when transported or stored empty and folds up or can be assembled rapidly without the use of tools.

The reinforced container 10 of the present invention includes a lightweight, collapsible, re-usable protective sleeve 16 that can be used at, for instance, a paint retail store, to house the bag 15 that contains, for instance, 1-5 gallons of paint. In operation, the protective sleeve 16 is utilized during the use of commonly available mechanical mixing machinery and is removed from the main paint package by a retail worker prior to product's store departure. It is previously determined that an octagonally-shaped container optimizes all desired physical and economic attributes for such a retail package. Thus protective sleeve 16 for this container is accordingly shaped to accommodate that exact shape. Some very important features of the protective sleeve 16 are: 1) lightweight fracture-resistant materials used such as plastic resins, aluminum or graphite fiber, 2) further light-weighting due to weight-reduction holes in side-walls, 3) a geometry which allows placement of the sleeve over the top of a heavy package and details (i.e.; finger holes) which then allow it to be removed from the top, without requiring lifting of the main package/box, 4) hinged and/or foldable collapsibility features which allow the device to be stored without consuming too much valuable retail storage space or counter space, when it is not used, 5) maximum surface contact between all container outer vertical panels and all corresponding sleeve inner vertical walls (form-fitting), 6) Sleeve height being slightly less than container height, so that mixing machinery holding platens can apply adequate pressure to the container, such that the entire bag-in-box is secured in the machinery throughout the entire liquid mixing process.

During mixing machine operation, the bag 15 flexes and pulsates constantly, because the inner liquid displaces in all directions. This protective sleeve 16 allows the lightest possible paper material be used in the container's construction because the need for flex and tear resistance is greatly reduced by sleeve containment. Such a protective sleeve can be effectively used in the many different types of mixing machinery in use such as, but not limited to, oscillating, orbital and gyroscopic.

Accordingly, one aspect of the present invention is directed to a reinforced container system comprises a container having a bottom wall, a pair of opposite side walls, a pair of opposite end walls, and opposed pairs of diagonal corner panels interposed between adjacent side and end walls to form an interior space. The bottom wall, the side walls, the end walls and the diagonal corner panels are joined to one another along vertical folds. The bottom wall includes two opposed glue panels each of which is foldably joined to respective longitudinal edges of the bottom wall and each of which attached to the respective side walls. A protective sleeve is configured to detachably attach to the container. The protective sleeve includes two side walls, two end walls and opposed pairs of diagonal corner walls interposed between adjacent side and end walls. The side walls, the end walls and the diagonal corner walls are joined to one another along four vertical hinges to whereby protect the container against tremendous forces and inertia caused by mixing or shaking machinery.

Another aspect of the present invention is directed to a reinforced container system comprises a container having a bottom wall, a pair of opposite side walls, a pair of opposite end walls, and opposed pairs of diagonal corner panels interposed between adjacent side and end walls. The bottom wall, the side walls, the end walls and the diagonal corner panels are joined to one another along vertical folds to form an interior space. The bottom wall includes two opposed glue panels each of which foldably joined to respective longitudinal edges of the bottom wall and each of which attached to the respective side walls. A liner insert is disposed in the container and is fitting closely in the container sidewalls and bottom wall in an overlapping relationship. A plastic bag is disposed in the interior space of the container and is confined within the liner insert in which the plastic bag includes a spout for flowable material. A protective sleeve is configured to detachably attach to the outer wall of the container. The protective sleeve includes two opposed side walls having inner surfaces, two opposed end walls and opposed pairs of diagonal corner walls interposed between adjacent side and end walls. The side walls, the end walls and the diagonal corner walls are joined to one another along four vertical hinges to whereby protect the container against tremendous forces and inertia caused by mixing or shaking machinery.

One further aspect of the present invention is directed to a reinforced container system comprises a container having a bottom wall, a pair of opposite side walls, a pair of opposite end walls, and opposed pairs of diagonal corner panels interposed between adjacent side and end walls. The bottom wall, the side walls, the end walls and the diagonal corner panels are joined to one another along vertical folds to form an interior space. The bottom wall includes two opposed glue panels each of which is foldably joined to respective longitudinal edges of the bottom wall and each of which attached to the respective side walls. A liner insert is disposed in the container and is fitting closely in the container sidewalls and bottom wall in an overlapping relationship. The liner insert is substantially coextensive in height with the container side walls and diagonal corner panels. A plastic bag is disposed in the interior space of the container and is confined within the liner insert. The plastic bag includes a spout for flowable material. A protective sleeve is configured to detachably attach to the outer wall of the container. The protective sleeve includes two opposed side walls having inner surfaces, two opposed end walls and opposed pairs of diagonal corner walls interposed between adjacent side and end walls. Two retaining plates each of which is attached to the respective inner surface of the side walls and aligned with the respective top edge of each side wall of the sleeve and extend downwardly therefrom. The side walls, the end walls and the diagonal corner walls are joined to one another along four vertical hinges to whereby protect the container against tremendous forces and inertia caused by mixing or shaking machinery.

While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments.

What is claimed is:

1. A reinforced container system comprising:

a container having a bottom wall, a pair of opposite side walls, a pair of opposite end walls, and opposed pairs of diagonal corner panels interposed between adjacent side and end walls, wherein the bottom wall, the side walls, the end walls and the diagonal corner panels are joined to one another along vertical folds, the bottom wall includes two opposed glue panels each of which are foldably joined to respective longitudinal edges of the bottom wall and each of which are attached to the respective side walls; and a protective sleeve configured to detachably attach to the container, the protective sleeve includes two side walls, two end walls and opposed pairs of diagonal corner walls interposed between adjacent side and end walls, the protective sleeve comprises two retaining plates each of which is attached to a respective inner surface of the side walls of the protective sleeve and wherein the side walls, the end walls and the diagonal corner walls of the protective sleeve are joined to one another along four vertical foldable collapsible features to whereby protect the container against tremendous forces and inertia caused by mixing or shaking machinery and wherein each respective retaining plate has a predetermined height which permits a longitudinal bottom edge of each respective retaining plate to substantially align with a respective top edge of the respective glue panels so that the protective sleeve is lifted up with the container when the container is lifted.

2. The reinforced container system of claim 1 wherein a longitudinal top edge of each respective retaining plate is aligned with the respective top edge of each side wall of the sleeve and extends downwardly therefrom.

3. The reinforced container system of claim 1 wherein each of the respective retaining plates is bolted to the respective inner surface of the side walls of the protective sleeve.

4. The reinforced container system of claim 1 wherein the protective sleeve is removed from the container without lifting the container.

5. The reinforced container system of claim 1 wherein the protective sleeve has a height that is slightly less than a height of the container so that the mixing machinery holding platens can apply adequate pressure to the container such that the container is secured in the machinery throughout an entire liquid mixing process.

6. The reinforced container system of claim 1 wherein the protective sleeve contains several perforations of different sizes which reduce the overall weight of the protective sleeve and further permits the passage of heat or moisture which is generated during a shaking operation of the reinforced container system.

7. The reinforced container system of claim 1 wherein the protective sleeve is made of a lightweight fracture-resistant material such as plastic resins, aluminum or graphite fiber.

8. The reinforced container system of claim 1 wherein the four vertical foldable collapsible features are defined by four hinges which permit the protective sleeve to be collapsed.

9. A reinforced container system comprising:

a container having a bottom wall, a pair of opposite side walls, a pair of opposite end walls, and opposed pairs of diagonal corner panels interposed between adjacent side and end walls wherein the bottom wall, the side walls, the end walls and the diagonal corner panels are joined to one another along vertical folds to form an interior space, the bottom wall includes two opposed glue panels each of which are foldably joined to respective longitudinal edges of the bottom wall and each of which are attached to the respective side walls;

a liner insert being disposed in the container, the liner insert fitting closely in the container sidewalls and bottom wall in an overlapping relationship;

a plastic bag disposed in the interior space of the container and being confined within the liner insert, wherein the plastic bag includes a spout for flowable material;

a protective sleeve configured to detachably attach to the side walls, end walls and corner panels of the container, the protective sleeve includes two opposed side walls having inner surfaces, two opposed end walls and opposed pairs of diagonal corner walls interposed between adjacent side and end walls, the protective sleeve comprises two retaining plates each of which is attached to a respective inner surface of the side walls of the protective sleeve and wherein the side walls, the end walls, and the diagonal corner walls of the protective sleeve are joined to one another along four vertical hinges to whereby protect the container against tremendous forces and inertia caused by mixing or shaking machinery and wherein each respective retaining plate has a predetermined height which permits a longitudinal bottom edge of each respective retaining plate to substantially align with a respective top edge of the respective glue panels so that the protective sleeve is lifted up with the container when the container is lifted.

10. The reinforced container system of claim 9 wherein a longitudinal top edge of each respective retaining plate is aligned with respective top edge of each side wall of the sleeve and extends downwardly therefrom.

11. A reinforced container system comprising:

a container having a bottom wall, a pair of opposite side walls, a pair of opposite end walls, and opposed pairs of diagonal corner panels interposed between adjacent side and end walls wherein the bottom wall, the side walls, the end walls and the diagonal corner panels are joined to one another along vertical folds to form an interior space, the bottom wall includes two opposed glue panels each of which are foldably joined to respective longitudinal edges of the bottom wall and each of which are attached to the respective side walls;

a liner insert being disposed in the container, the liner insert fitting closely in the container sidewalls and bottom wall in an overlapping relationship, the liner insert being substantially coextensive in height with the container side walls and diagonal corner panels;

a plastic bag disposed in the interior space of the container and being confined within the liner insert, wherein the plastic bag includes a spout for flowable material;

a protective sleeve configured to detachably attach to the side walls, end walls and corner panels of the container, the protective sleeve includes two opposed side walls having inner surfaces, two opposed end walls and opposed pairs of diagonal corner walls interposed between adjacent side and end walls, two retaining plates of which are attached to the respective inner surface of the side walls of the protective sleeve and are aligned with the respective top edge of each side wall of the sleeve and extend downwardly therefrom and wherein the side walls, the end walls and the diagonal corner walls of the sleeve are joined to one another along four vertical hinges to whereby protect the container against tremendous forces and inertia caused by mixing or shaking machinery and wherein the protective sleeve has a height that is slightly less than a height of the container so that the mixing machinery holding platens can apply adequate pressure to the container such that the container, the liner and the plastic bag are secured in the mixing machinery throughout an entire liquid mixing process.

12. The reinforced container system of claim 11 wherein the protective sleeve is octagonal in shape.

* * * * *